US008307515B2

(12) United States Patent
Ramsauer

(10) Patent No.: US 8,307,515 B2
(45) Date of Patent: Nov. 13, 2012

(54) HANDLE SHELL FOR CLIPPING INTO A CUTOUT SECTION IN A THIN WALL

(76) Inventor: Dieter Ramsauer, Schwelm (DE)

( * ) Notice: Subject to any disclaimer, the term of this patent is extended or adjusted under 35 U.S.C. 154(b) by 440 days.

(21) Appl. No.: 12/377,717

(22) PCT Filed: Jun. 15, 2007

(86) PCT No.: PCT/EP2007/005286

§ 371 (c)(1),
(2), (4) Date: Feb. 23, 2009

(87) PCT Pub. No.: WO2008/022664

PCT Pub. Date: Feb. 28, 2008

(65) Prior Publication Data

US 2010/0281651 A1 Nov. 11, 2010

(51) Int. Cl.
*A47B 95/02* (2006.01)

(52) U.S. Cl. ..... 16/415; 16/416; 16/413; 16/DIG. 24

(58) Field of Classification Search ..... 16/415, 16/416, 413, 422, 430, 443, DIG. 12, DIG. 18, 16/DIG. 19, DIG. 24; 312/348.6, 330.1; D6/494, 510

See application file for complete search history.

(56) References Cited

U.S. PATENT DOCUMENTS

| | | | | |
|---|---|---|---|---|
| 2,160,762 | A * | 5/1939 | Stenberg | 16/443 |
| 3,236,204 | A | 2/1966 | Joseph | |
| 3,932,010 | A | 1/1976 | Kenworthy | |
| 4,586,762 | A * | 5/1986 | Kennedy et al. | 16/416 |
| 4,744,126 | A * | 5/1988 | Bisbing | 16/443 |
| 4,803,755 | A * | 2/1989 | Pohlman | 16/443 |
| 5,074,009 | A * | 12/1991 | Simonton et al. | 16/416 |
| 7,882,594 | B2 * | 2/2011 | Ramsauer | 16/422 |

FOREIGN PATENT DOCUMENTS

| | | |
|---|---|---|
| DE | 29720992 | 3/1999 |
| JP | 9310537 | 12/1997 |
| JP | 2006 183234 | 7/2006 |

OTHER PUBLICATIONS

"Brochure 6-230"( Hanide Dish), "Modular Haedware System", DIRAK-Guide 2004/2005, published Aug. 2004 by DIRAK GmbH & Co. KG, Koenigsfelder Strasse 1, D-58256 Ennepetal, Germany.

* cited by examiner

*Primary Examiner* — Jeffrey O Brien
(74) *Attorney, Agent, or Firm* — Frommer Lawrence & Haug LLP

(57) ABSTRACT

The description relates to a handle shell to be installed in an opening in a thin wall such as a sheet-metal door leaf, a side wall of a sheet-metal cabinet, or the like, with a flange part, fastening elements proceeding from or being received in the flange part for fastening the flange part to the thin wall, and with a shell part. According to the invention, the flange part and shell part are two separate structural component parts, the flange part has a first flange supported on the edge of the opening in the thin wall, and the shell part of the handle shell has another flange which is enclosed in such a way by the first flange part after being installed that it extends between the thin wall and the first flange part.

9 Claims, 20 Drawing Sheets

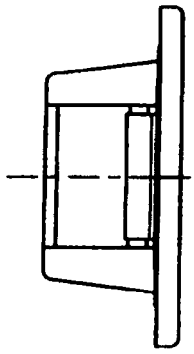
Fig. 4 H
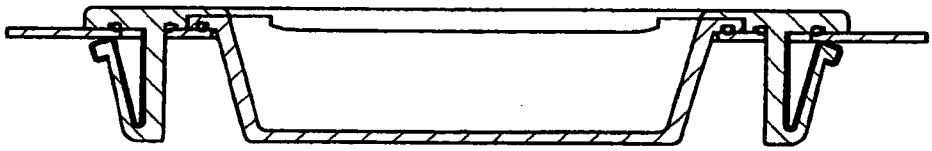
Fig. 4 I
Fig. 4 K
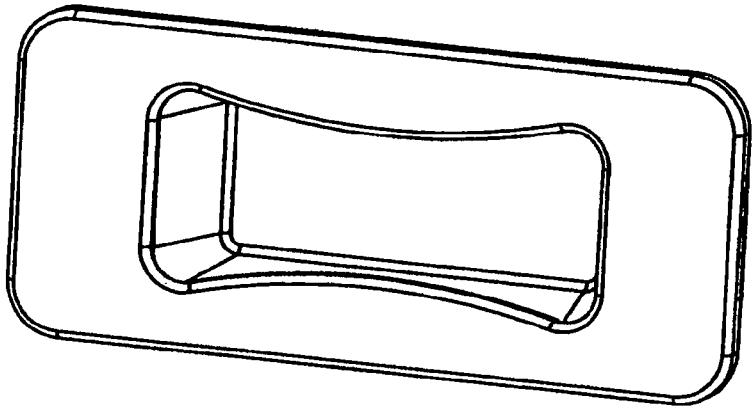
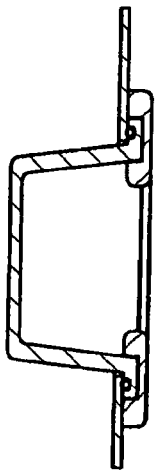
Fig. 4 J

HANDLE SHELL FOR CLIPPING INTO A CUTOUT SECTION IN A THIN WALL

The present application claims priority from PCT Patent Application No. PCT/EP2007/005286 filed on Jun. 15, 2007, which claims priority from German Patent Application No. 20 2006 012 797.6 filed on Aug. 19, 2006, the disclosure of which is incorporated herein by reference in its entirety.

BACKGROUND OF THE INVENTION

1. Field of the Invention

The invention is directed to a handle shell to be installed in an opening in a thin wall, having a flange part, fastening elements proceeding from or being received in the flange part for fastening the flange part to the thin wall, and with a shell part.

2. Description of Related Art

A handle shell of the kind mentioned above is already known, for example, from Brochure 6-230 by DIRAK or from DE 297 20 992 U1. The known arrangement has a sloping grip surface that can be engaged by hand. When sheet-metal doors or drawers open stiffly, the hand may slip from this sloped surface. The grip surface should also, if possible, extend at right angles to the pulling direction of the hand, that is, parallel to the thin wall. However, it is very difficult to produce grip areas of this kind in handle shells because complicated tools with gates are required for injection molding corresponding plates which are grasped from behind.

Also, sealing presents problems in the known arrangement.

Finally, there should be the option of providing two back-grip surfaces located opposite from one another.

SUMMARY OF THE INVENTION

It is the object of the invention to provide a handle shell for installation in an opening in a thin wall which does not have the drawbacks mentioned above and which can be constructed in such a way that there are two grip surfaces located opposite from one another.

The above-stated object is met in that the flange part and shell part are two separate structural component parts, in that the flange part has a first flange supported on the edge of the opening in the thin wall, and in that the shell part of the handle shell has another flange which is enclosed in such a way by the first flange and its fastening elements after being installed that it extends between the thin wall and the first flange part.

This makes it possible to make do without a complicated injection mold and, at the same time, to produce back-grip surfaces in which there is no risk that the hand will slip off in stiffly operating doors or drawers. Further, it is possible to shape the shell so as to form two oppositely located surfaces which can be gripped from behind and handling is facilitated.

Good stability is achieved when the additional flange is enclosed (FIG. 2A) or penetrated (FIG. 1A) by the fastening elements.

According to a another embodiment form, a snap-type installation is made possible when the fastening elements proceeding from the first flange interact in a snap-like manner with an edge of the opening when installed and have a run-in sloped surface and a holding sloped surface at approximately right angles to the latter.

Screw fastening is also possible, e.g., when the fastening elements received by the first flange are fastening screws which are guided through bore holes or notches or openings in the thin wall.

The openings provided in the thin wall for the fastening elements can be widened and/or provided with additional notches.

According to another embodiment form, additional openings can also be provided in the thin wall for the fastening elements.

The additional flange can be provided with notches and/or openings for receiving fastening elements or for allowing the fastening elements to pass through.

According to another embodiment form, the holding element can be a slide which is arranged in the first flange so as to be displaceable parallel to the thin wall.

The slide can be mounted so as to be displaceable perpendicular to the longitudinal extension of the handle shell.

According to another embodiment form, the holding element is U-shaped or V-shaped in cross section and is secured to the first flange by one leg, its second leg forming a tongue which is movable in a springing manner in direction of the longitudinal extension of the handle shell.

This embodiment form corresponds to the prior art with respect to operation, but in the prior art the tongue can only be arranged at one side, whereas in the invention tongues of this kind can be provided at two oppositely located longitudinal edges so that it is possible to provide two surfaces that can be engaged by the hand.

The flange and the fastening element proceeding from it can be injection-molded in one piece from plastic.

The fastening element that is injection molded from plastic can have a metal spring reinforcement to reinforce the plastic whose strength may possibly be insufficient.

A metal spring reinforcement of this kind can contact the inner sides of the U-leg or V-leg made of plastic.

Alternatively, the metal spring reinforcement encloses at least the free end of the U-leg or V-leg forming the tongue.

According to another embodiment form, the metal spring reinforcement encloses the entire U-leg or V-leg forming the tongue.

The opening or openings in the thin wall can be sealed by sealing rings which surround the cross section of the shell proceeding from the additional flange and/or the cross section of the fastening elements proceeding from the first flange.

According to a further development of the invention, the shell part with its flange can be preassembled at the flange part of the handle shell.

The grip hole of the flange part of the handle shell can have narrowed portions for forming undercuts to facilitate gripping.

Grip strips can extend inward in direction of the shell part from the edges of the grip hole of the flange part.

BRIEF DESCRIPTION OF THE DRAWINGS

FIGS. 4A to 4K show corresponding views of an embodiment form which is outfitted with tongues which are reinforced by a metal spring and with sealing strips.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1A:
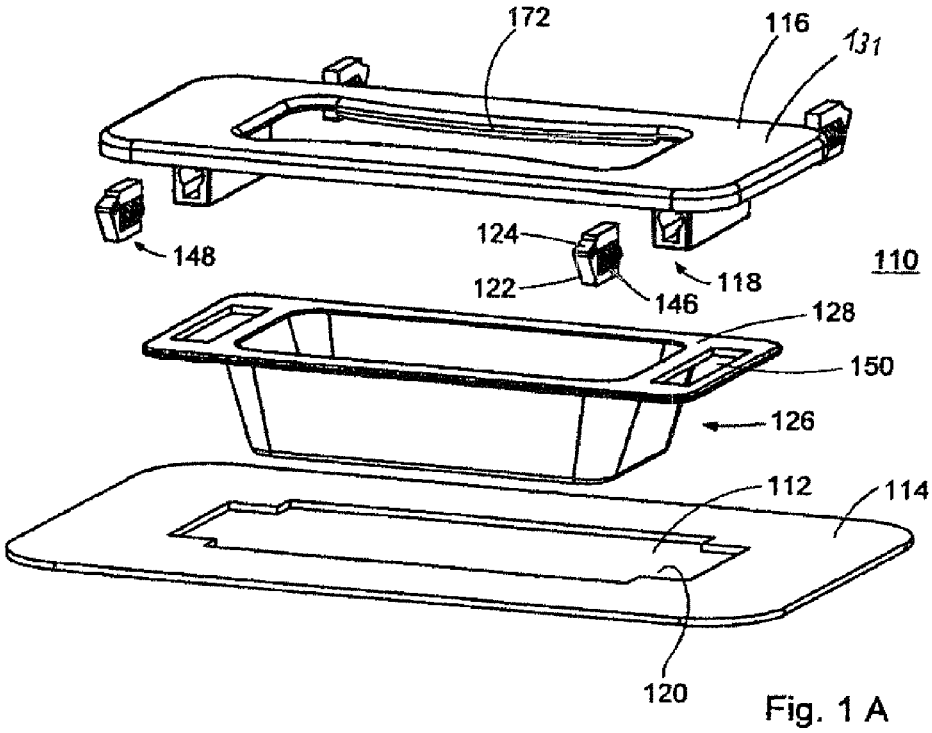
FIG. 1A shows a perspective, exploded view of a handle shell constructed according to the invention.
Figure 1B:
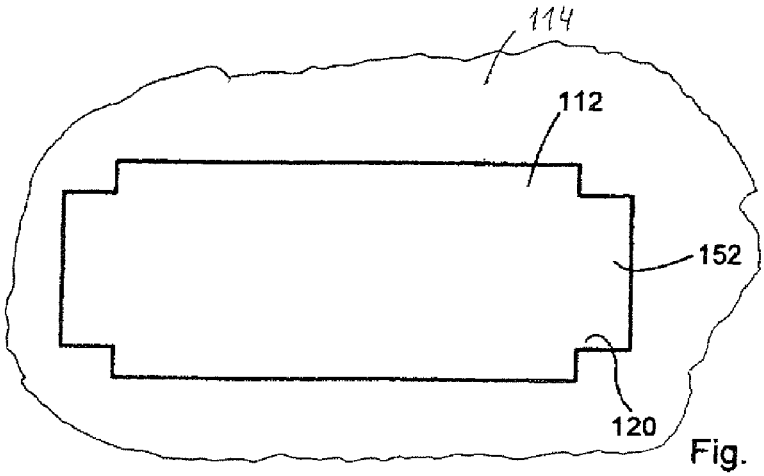
FIG. 1B shows an opening in the thin wall which is suited to the handle shell according to FIG. 1A.
Figure 1C:
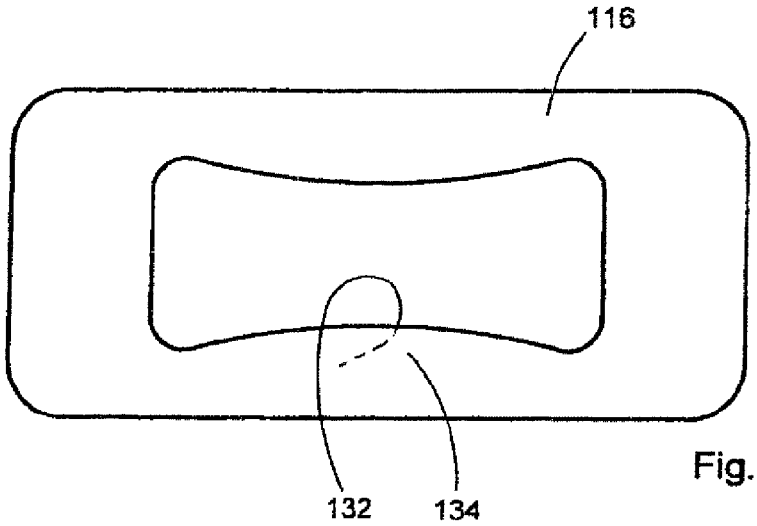
FIG. 1C shows a top view of the flange part of the handle shell according to FIG. 1A.
Figure 1D:
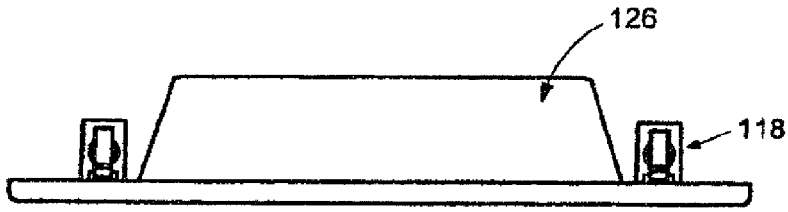
FIG. 1D shows a side view of the flange part of the handle shell according to FIG. 1A.
Figure 1E:
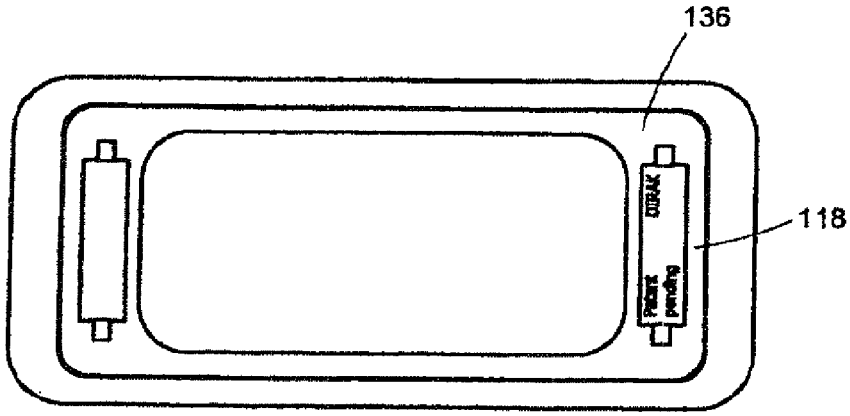
FIG. 1E shows a rear view of the flange part of the handle shell according to FIG. 1A.
Figure 1F:
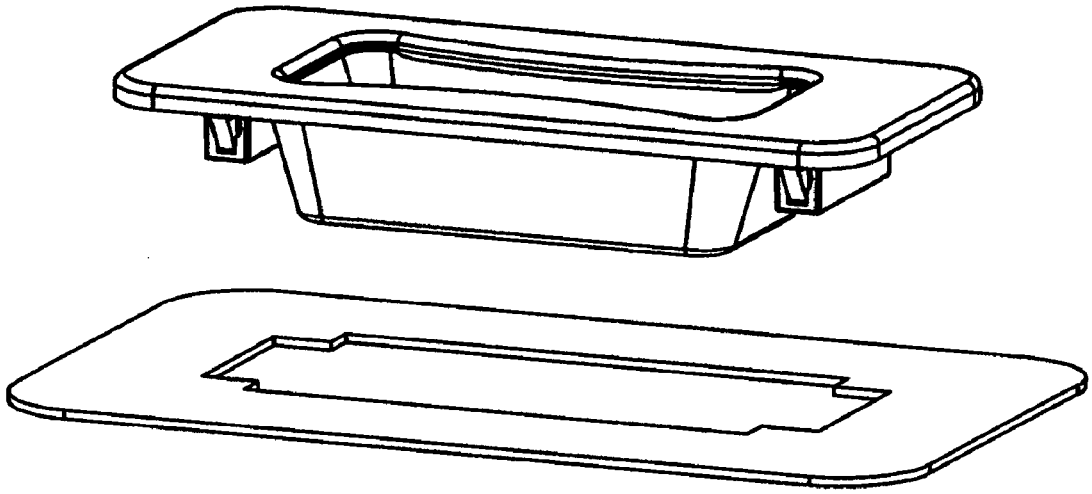
FIG. 1F and FIG. 1G are two perspective views of the preassembled handle shell before and after arranging in the thin wall.
Figure 1G:
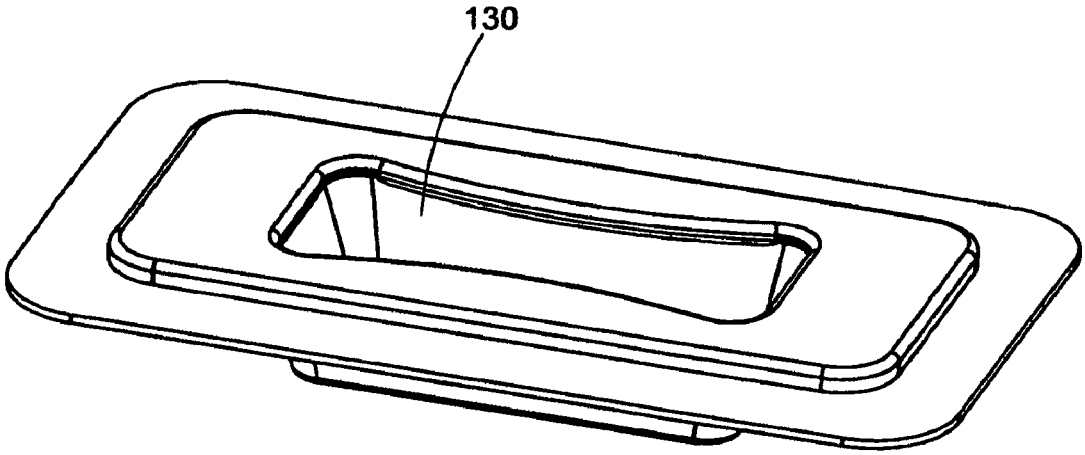
Figure 1H:
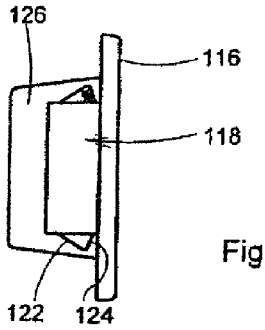
FIG. 1H is a front view of the handle shell according to FIG. 1A after preassembly and arrangement in the thin wall.
Figure 1I:
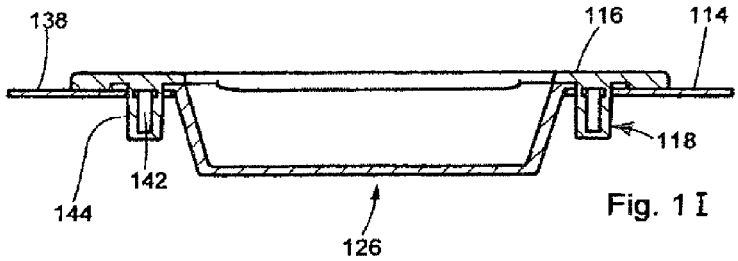
FIG. 1I is an axial sectional view of the handle shell according to FIG. 1A after preassembly and arrangement in the thin wall.

FIG. 1A shows an exploded view of a handle shell 110 for snapping into an opening 112 in a thin wall 114 such as a sheet-metal door leaf, a side wall of a sheet-metal cabinet, or the like, with a flange part 116 from which fastening elements protrude 118 or which can receive fastening elements 118 of this kind. The fastening elements 118 interact with an opening edge 120 when snapping in and have a run-in sloped surface 122 and a holding sloped surface 124 approximately at right angles to the latter. Further, the handle shell 110 has a shell part 126. This shell part 126 has another flange 128 which is surrounded in such a way by the flange part 116 and its holding elements 118 after snapping into the thin wall, as is shown in FIGS. 1F and 1G, as well as in longitudinal section in FIG. 1E, that it extends between the thin wall 114 and the flange part 116.

Because the handle shell comprises two parts it is possible to provide the external flange part 116 with narrowed portions in the grip hole 130 enclosed by the flange part 116 and flange 128 to form undercuts 132 in order to facilitate gripping for narrowed portions 134. Because of this construction in two parts, the flange part 116 with the fastening elements—insofar as the latter are connected in one piece with the flange part—and the shell part 126 with its conical shell can easily be injection molded with simple injection molds.

Figure 1J:
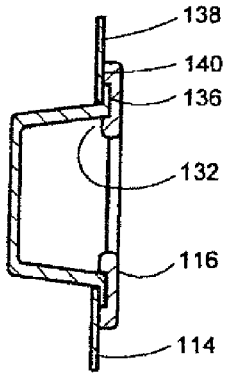
FIG. 1J is a cross-sectional view of the handle shell according to FIG. 1A after preassembly and arrangement in the thin wall.
Figure 1K:
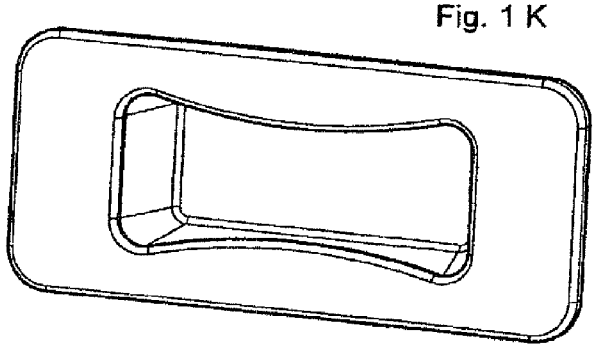
FIG. 1K shows a perspective top view of the handle shell according to FIG. 1A after preassembly and arrangement in the thin wall.
Figure 2A:
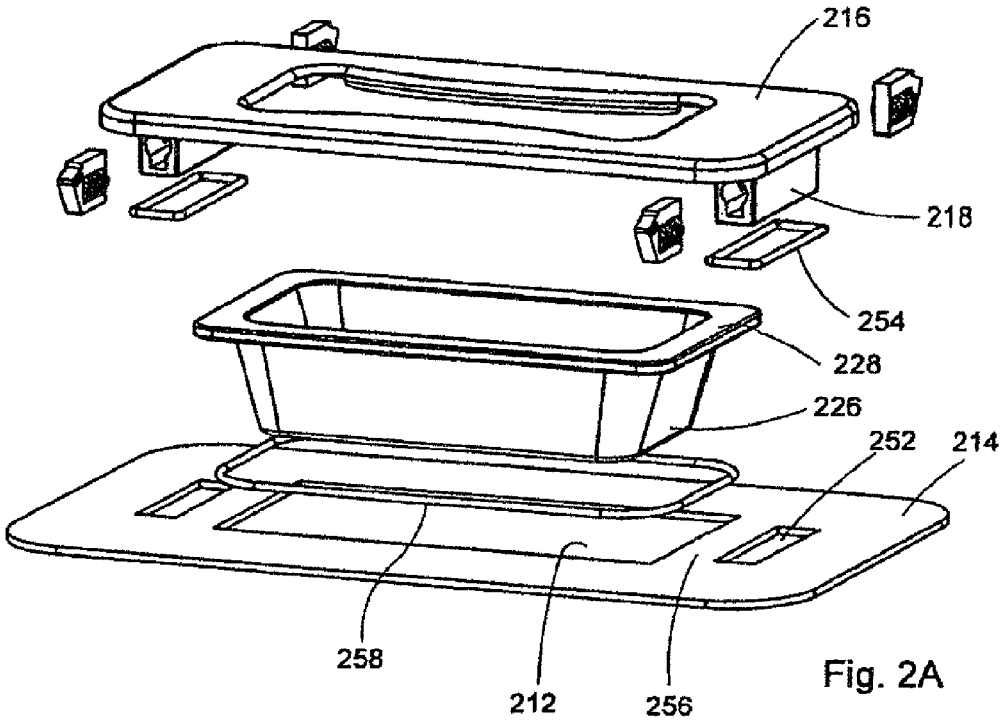
FIGS. 2A to 2K are corresponding views of an alternative embodiment form which is outfitted with sealing rings.
Figure 2B:
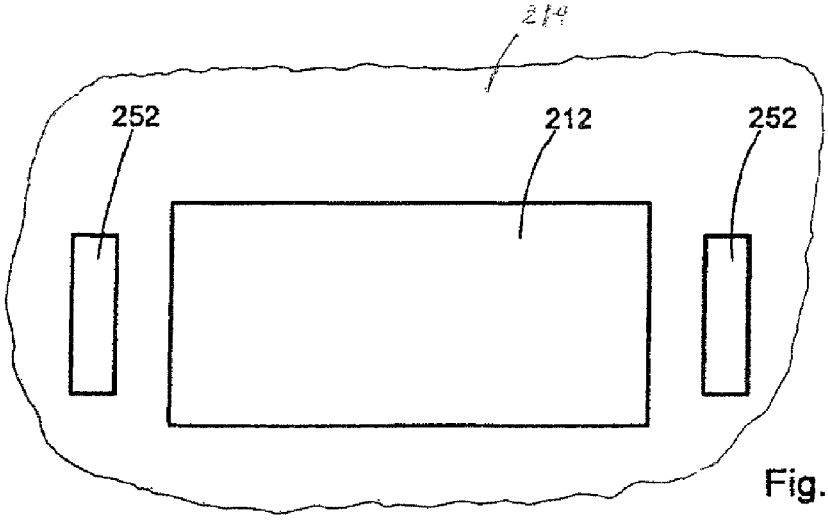
Figure 2C:
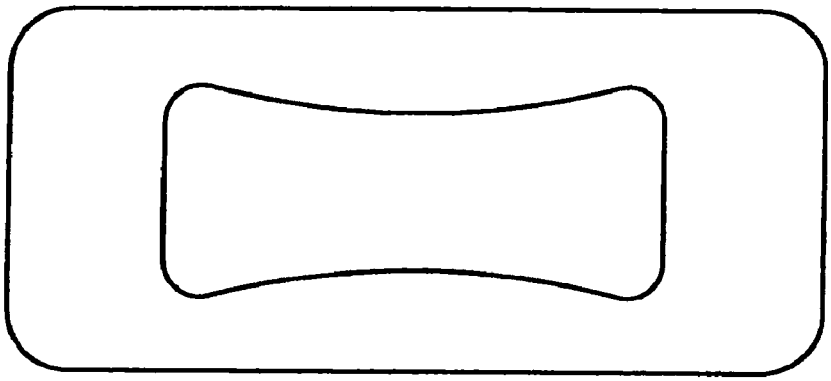
Figure 2D:
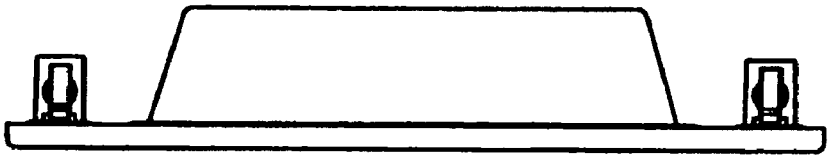
Figure 2E:
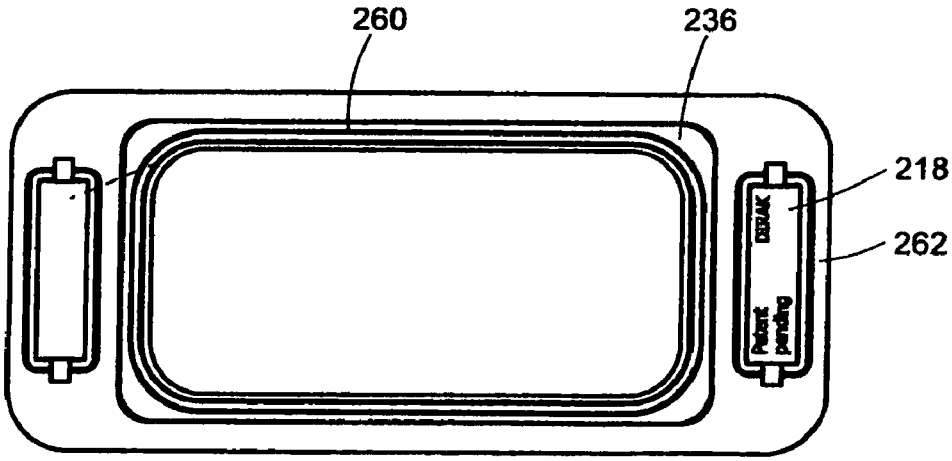

Accordingly, the two parts can be designed in such a way that the flange 128 of the shell part 126 can be received in a recessed surface 136 on the back of the flange part 116 (see FIG. 1J) so that the edge surface 140 of the flange part 116 contacts the outer surface 138 of the thin wall 114 so as to be flush with it. In the embodiment forms shown in FIGS. 1A to 1K, projections 144 provided with a channel 142 proceed from the flange part 116. A slide 148 which is outfitted with a spring 146 is arranged in the channel 142 so as to be axially displaceable against spring force. This slide which is formed, e.g., by a metal plate has the sloped surfaces 122, 124 mentioned above. When the shell is snapped into the opening 112, the run-in sloped surface 122 is pushed into the channel 142 by an edge 120 of the opening 112 against the force of the spring and is pushed back until the holding sloped surface 124 is reached, whereupon the holding surface 124 contacts the lower edge of the opening 112 due to the spring force 146 and is accordingly securely held without play. In the embodiment form shown in FIG. 1A, the shell part 126 has a flange 128 having openings 150 for receiving the fastening elements 118. The handle shell 110 can be preassembled on this, that is, put into a state in which the shell part 126 is connected to the flange part 116 (see FIGS. 2C, 2D and 2E), which preassembled handle shell can then be snapped into the opening 112 according to FIGS. 1A and 1B. This results in the handle shell which is shown in FIG. 1E completely mounted in the thin wall.

The embodiment form according to FIGS. 1A to 1K shows an opening 112 which is formed with additional notches 152 which makes it possible to arrange the fastening elements 118 very close to the shell part 126. This results in a shorter embodiment form for the handle shell.

Figure 2F:
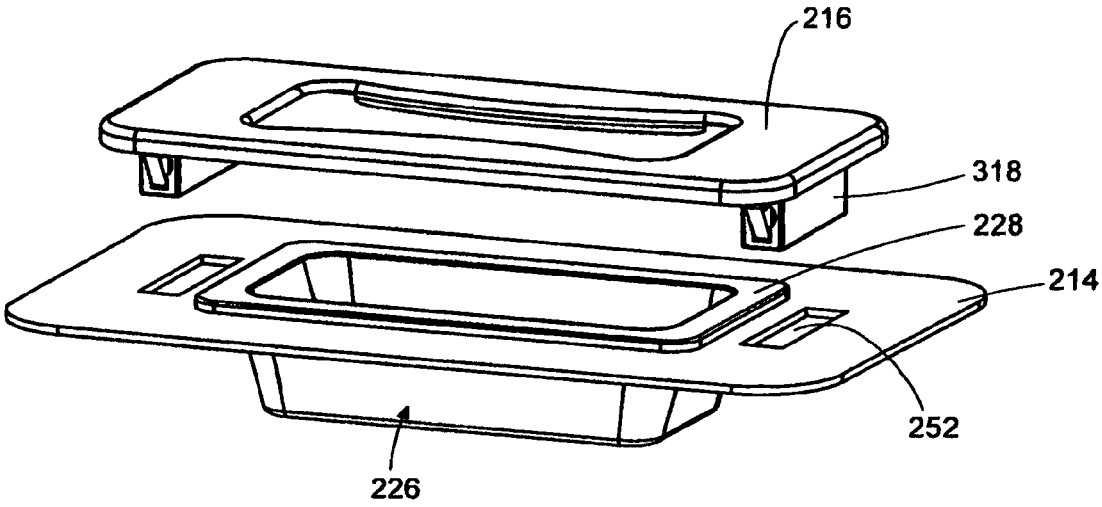
Figure 2G:
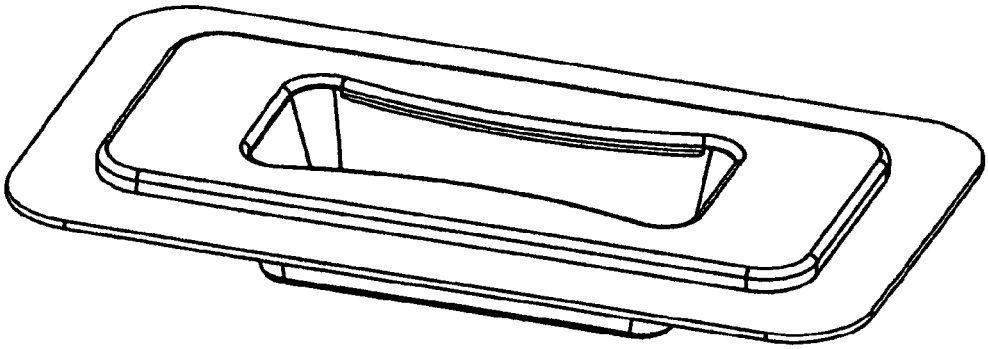
Figure 2H:
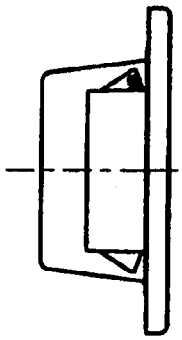
Figure 2I:
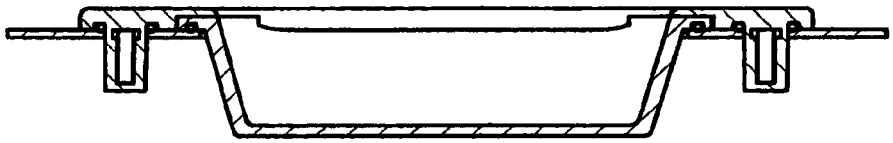
Figure 2J:
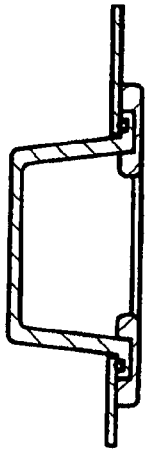
Figure 2K:
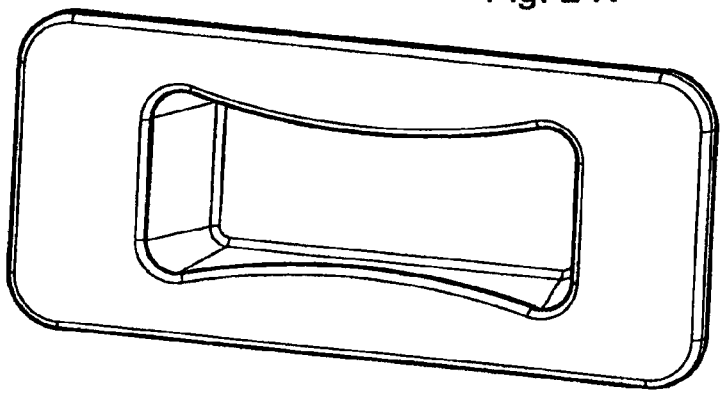

In the embodiment form shown in FIGS. 2A to 2K, an additional opening 252 is provided in the thin wall 214 for the fastening element 218, which allows the opening 252 to be outfitted with a sealing ring 254 because a web 256 is now provided between the openings 212 and 252 on which the sealing ring 254 can be supported. A correspondingly larger sealing ring 258 is provided in the opening 212 in that a corresponding groove-shaped receptacle 260 is provided in the recessed surface 236 shown in FIG. 2E. In a corresponding manner, an annular groove 262 is also provided for the fastening element 218. As can be seen in FIG. 2F, the flange 228 has no openings for the passage of the fastening elements 218. A preassembly is therefore not provided. Rather, according to FIG. 2F, the shell part 226 is first inserted into the opening 212 of the thin wall (without a snap-in action) and the flange part 216 with the two fastening elements 218 is subsequently snapped into the corresponding openings 252 in the thin wall 214 resulting in the form depicted in FIG. 2G.

Figure 3A:
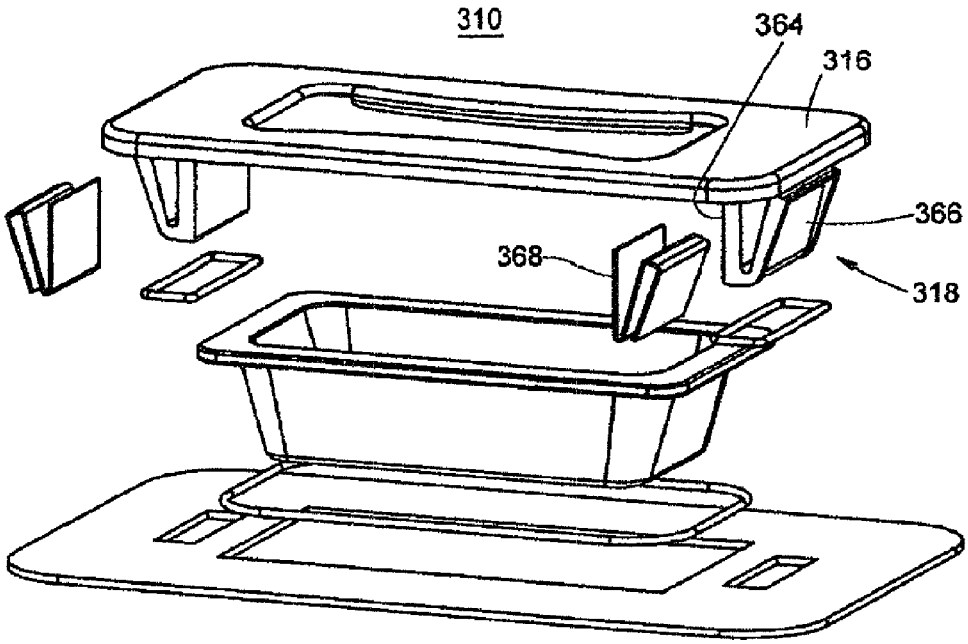
FIGS. 3A to 3K show corresponding views of an embodiment form which is outfitted with a plastic tongue reinforced by a metal spring.
Figure 3B:
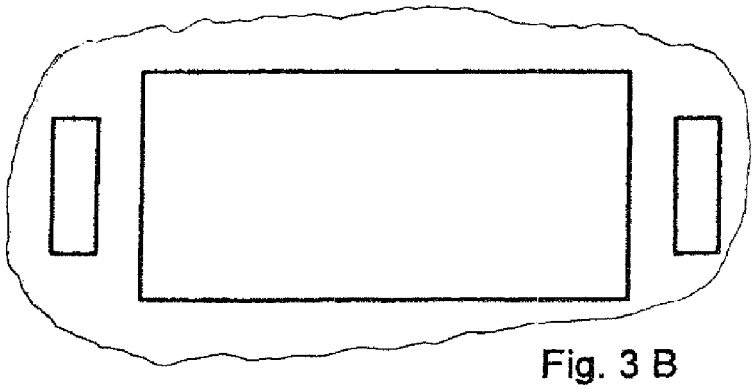
Figure 3C:
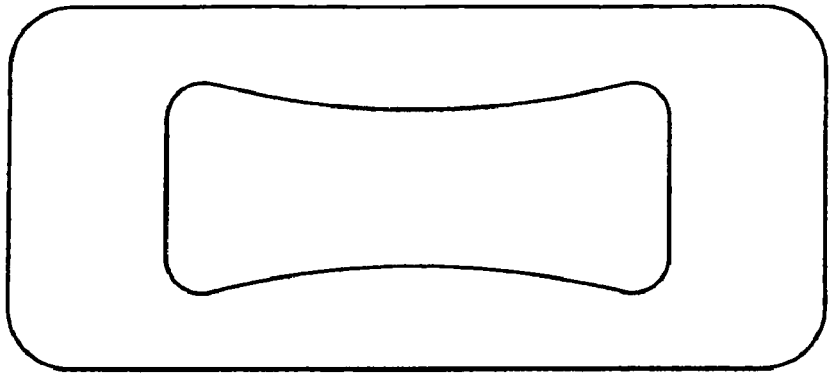
Figure 3D:
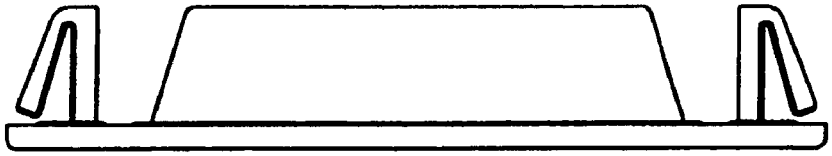
Figure 3E:
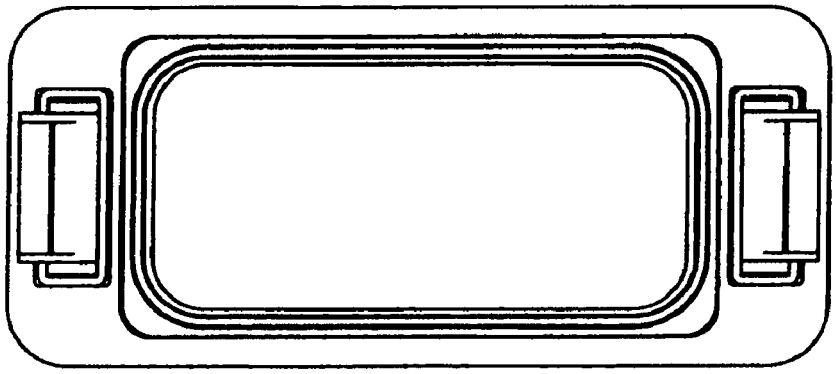
Figure 3F:
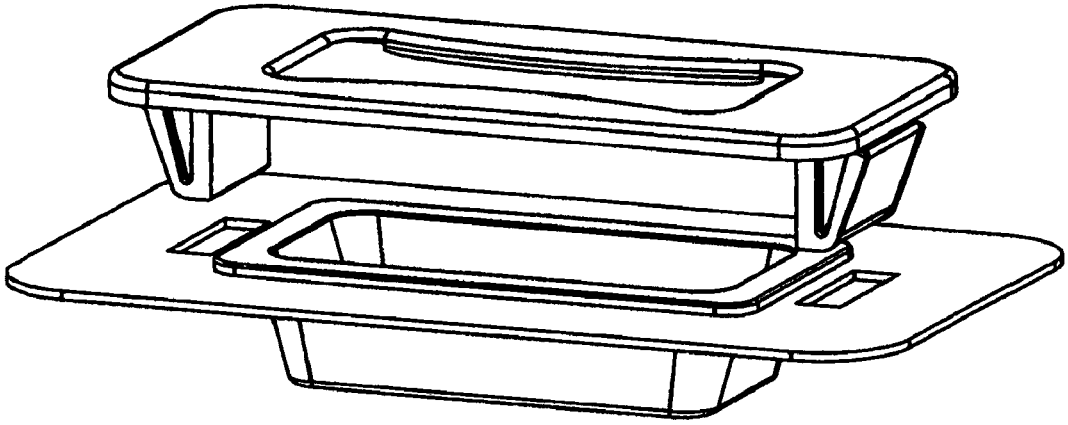
Figure 3G:
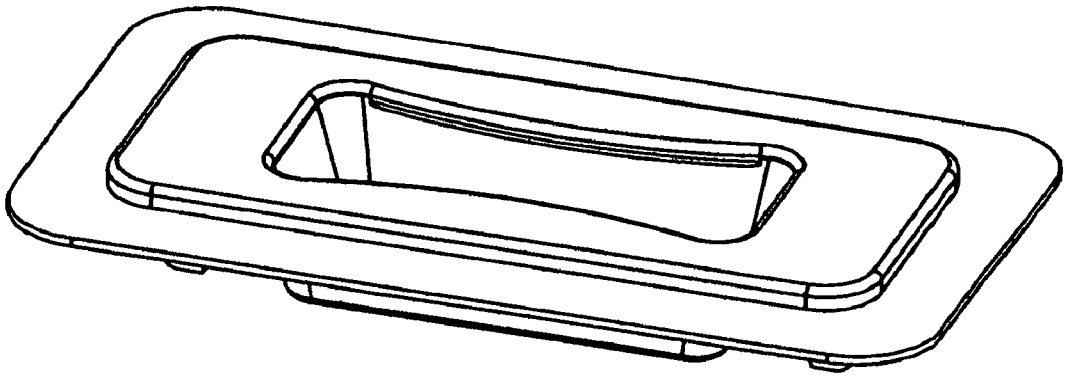
Figure 3H:
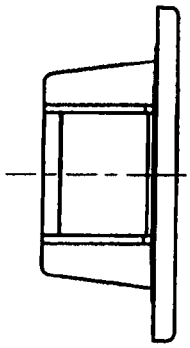
Figure 3I:
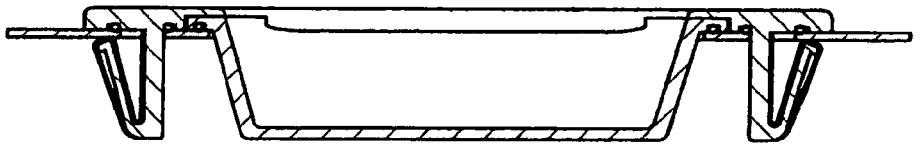
Figure 3J:
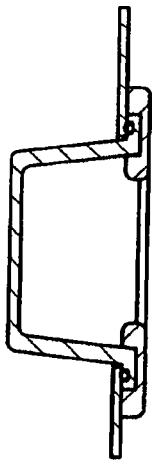
Figure 3K:
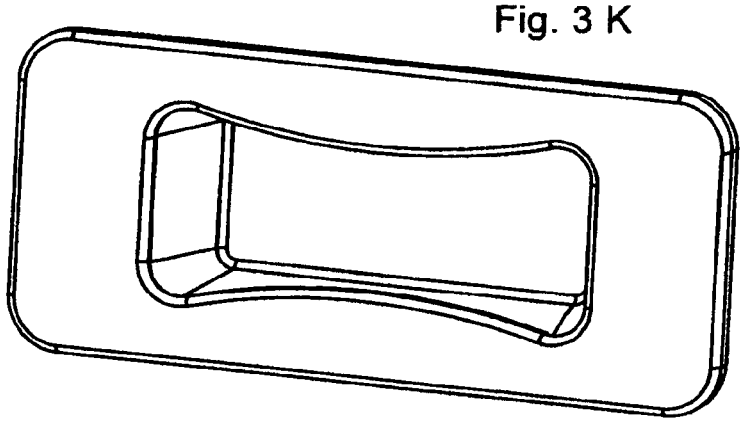

In the embodiment form according to FIGS. 3A to 3K, another fastening element 318 is provided which, in this case, forms a U or a V in cross section and is secured by one leg 364 to the first flange part 316, while its second leg 366 forms a tongue which is movable in a springing manner in direction of the longitudinal extension of the handle shell 310. Since the spring force of plastics is limited, it may be advisable to provide a metal spring reinforcement 368 as is shown in FIG. 3A. The metal spring reinforcement contacts the inner sides of the U-leg or V-leg of the holding element device 318 made of plastic.

Figure 4A:
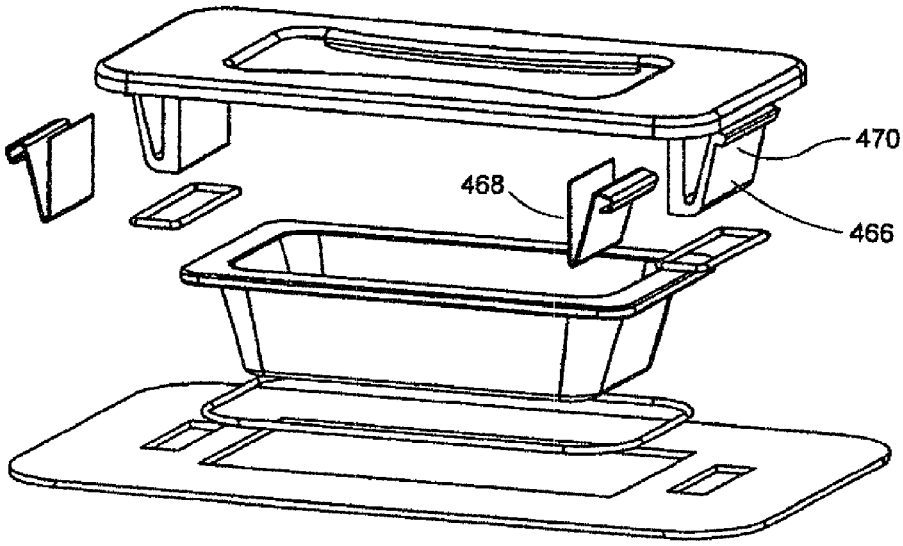
Figure 4B:
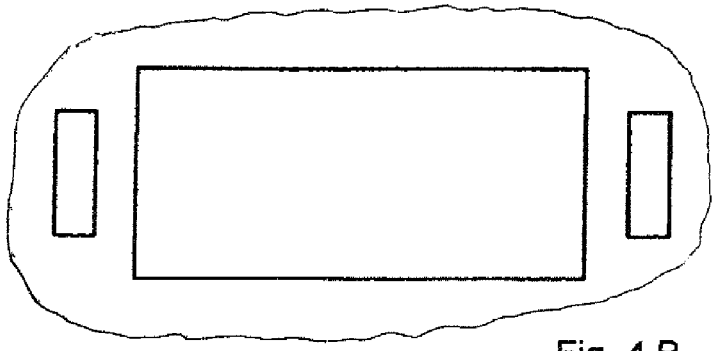
Figure 4C:
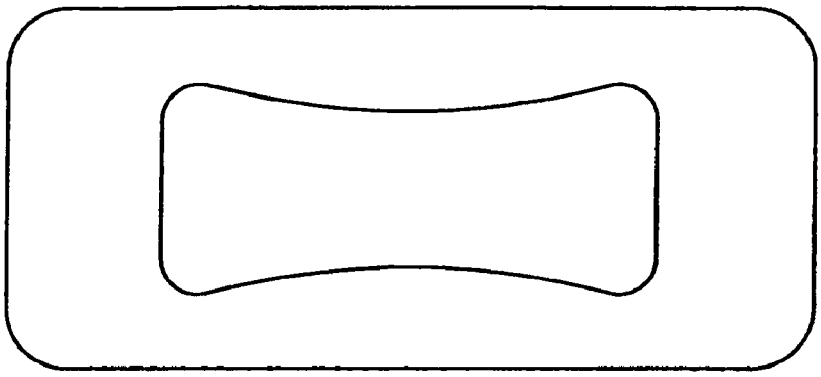
Figure 4D:
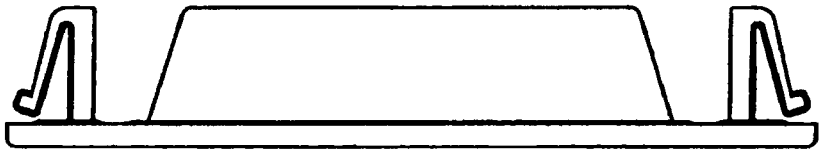
Figure 4E:
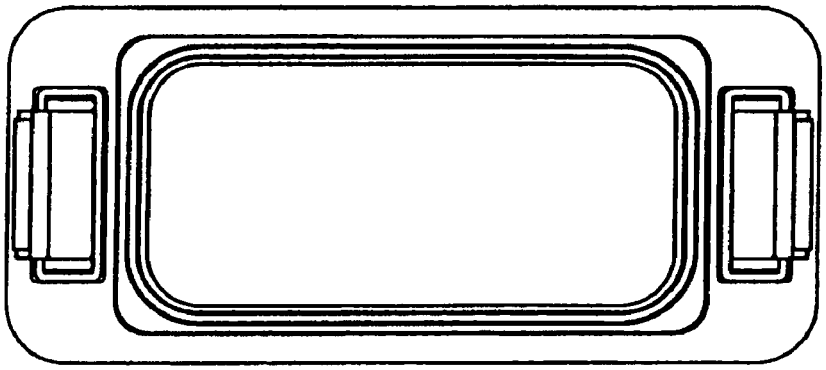
Figure 4F:
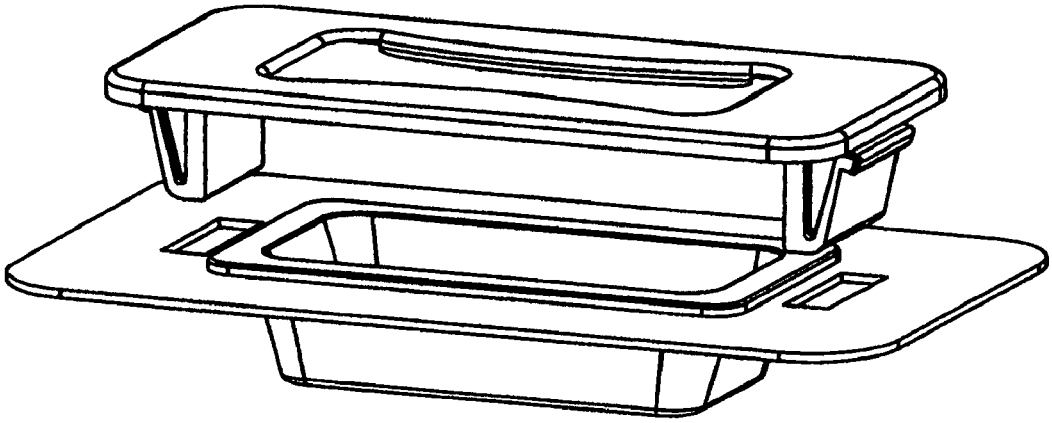
Figure 4G:
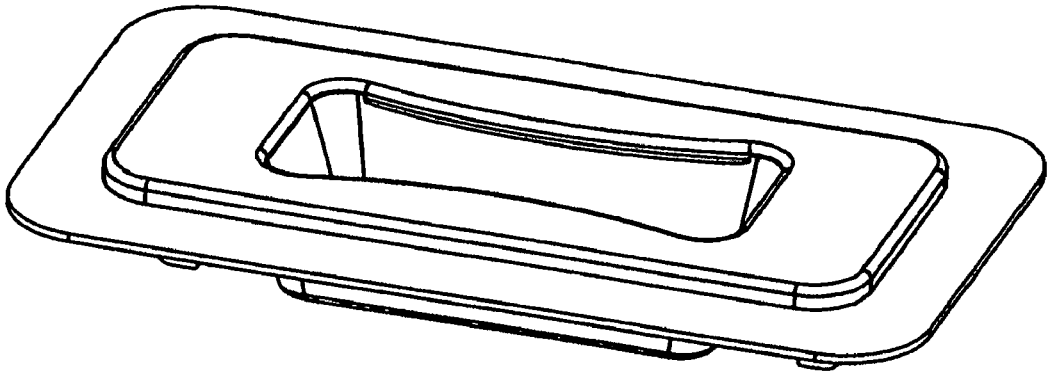
Figure 5A:
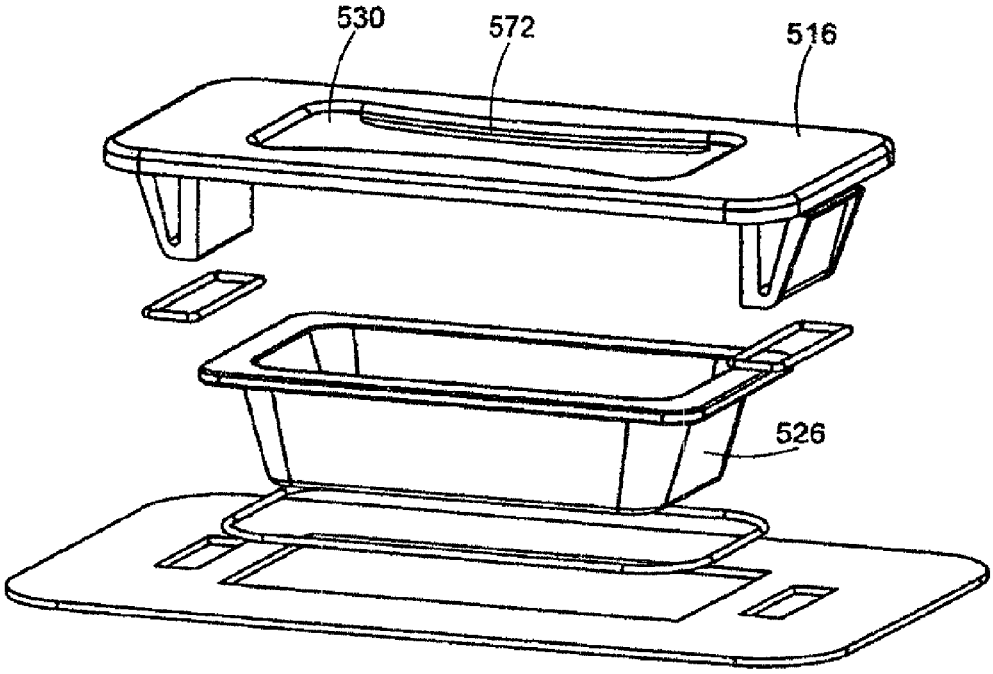
FIGS. 5A to 5K show another embodiment form.
Figure 5B:
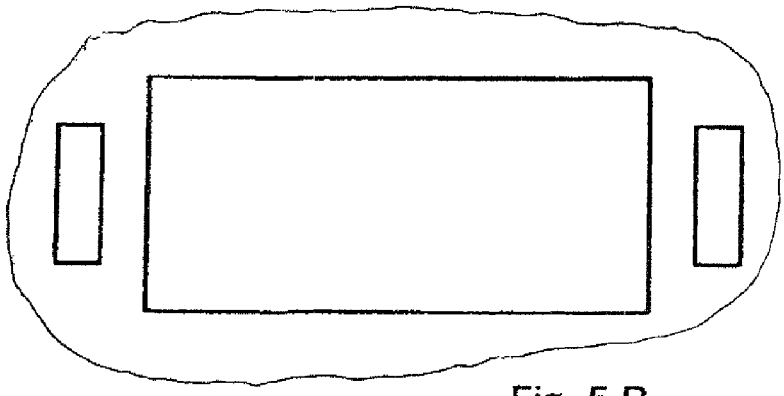
Figure 5C:
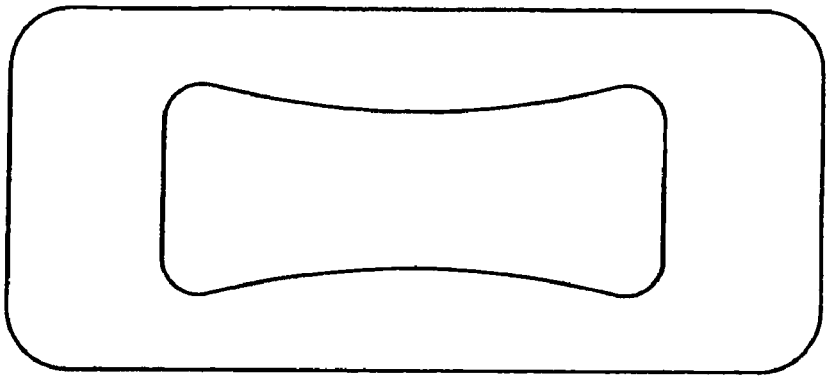
Figure 5D:
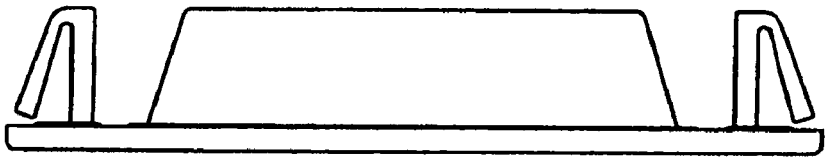
Figure 5E:
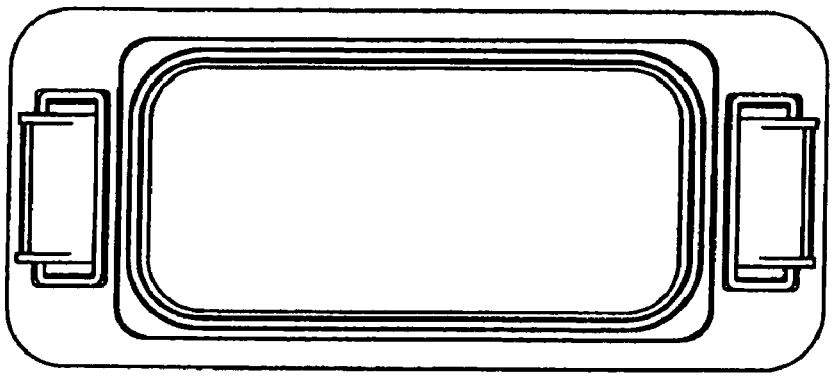
Figure 5F:
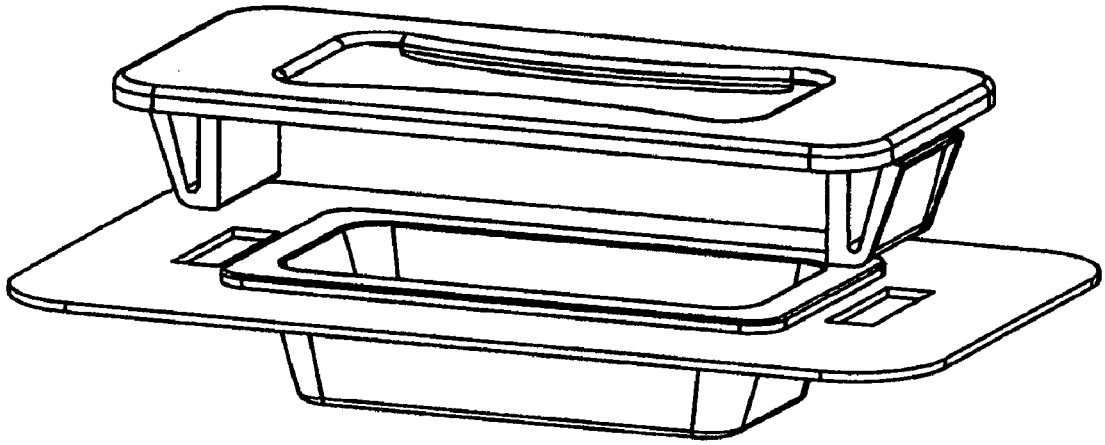
Figure 5G:
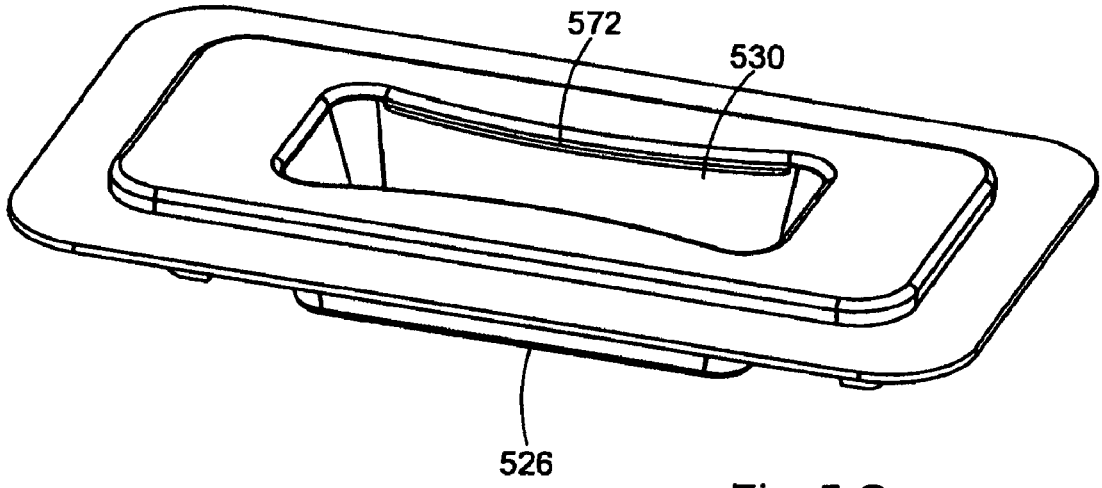
Figure 5H:
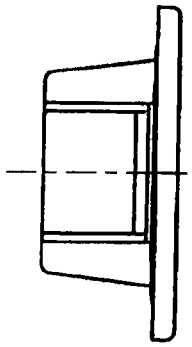
Figure 5I:
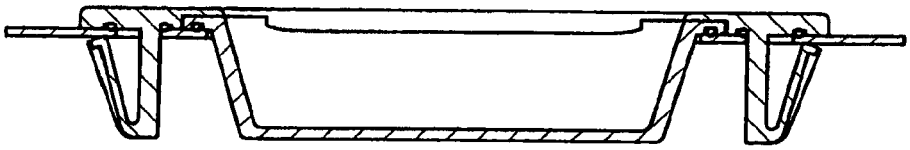
Figure 5J:
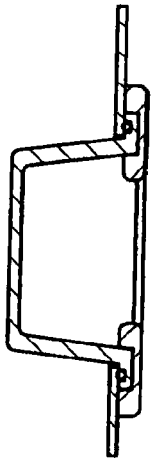
Figure 5K:
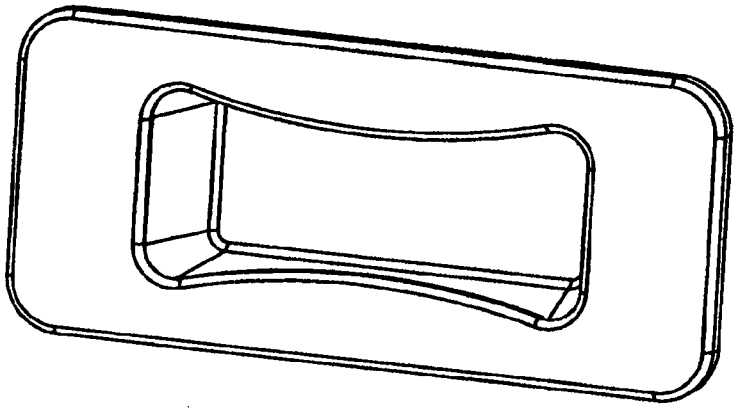

In another embodiment form shown in FIG. 4A, this spring is constructed in such a way that the metal spring reinforcement 468 encloses at least the free end 370 of the U-leg or V-leg 466 forming the tongue. In the embodiment form according to FIG. 3A, the metal spring reinforcement 368 encloses the totality of the U-leg or V-leg 364, 366 forming the tongue.

In the embodiment form according to FIGS. 5A to 5K, there is no reinforcement by a metal spring. In other respects, this embodiment form resembles that of FIGS. 3A to 3K.

Reliability is further increased when grip strips 572 proceed from the edges of the grip hole 530 and of the flange part 516 inward in direction of the shell part 526.

It is also possible to carry out the fastening by means of screws, which is not shown. The screws are guided through bore holes or notches or openings in the thin wall. The first flange can have threaded blind holes which open into the flange supporting surface and accept the screws, whose heads are supported, e.g., on the back of the thin wall.

COMMERCIAL APPLICABILITY

The invention is commercially applicable in switch cabinet construction.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

REFERENCE NUMBERS

110, 210, 310 handle shell
112, 212 opening
114, 214 thin wall
116, 216, 316, 516 flange part
118, 218, 318 fastening element
120 edge of opening
122 run-in sloped surface
124 holding sloped surface
126, 226, 526 shell part
128, 228 flange
130, 530 grip hole
131 additional flange
132 undercuts
134 narrow portions
136, 236 recessed surface
138 outer surface
140 edge surface
142 channel
144 projection
146 spring
148 slide
150 opening
152, 252 notch, opening
254 sealing ring
256 web
258 sealing ring
260 groove for circular seal
262 groove
364 leg
366, 466 second leg (tongue)
368, 468 metal spring reinforcement
470 free end
172, 572 grip strips

The invention claimed is:

1. A handle shell to be installed in an opening in a thin wall, comprising:

a flange part;

at least two fastening elements proceeding from the flange part for fastening the flange part to the thin wall; and a shell part;

wherein the flange part and shell part are two separate structural component parts, wherein the flange part has a first flange supported on the edge of the opening in the thin wall, and wherein the shell part of the handle shell has another flange which is enclosed in such a way by the first flange after being installed that it extends between the thin wall and the first flange, wherein the another flange is provided with notches or openings for receiving fastening elements or for allowing the fastening elements to pass through;

wherein each fastening element includes a housing and a slide which is arranged in the housing so as to be displaceable parallel to the thin wall;

wherein the slide is mounted so as to be displaceable perpendicular to the longitudinal extension of the handle shell;

wherein the flange part and the housing of the fastening elements are formed as one integral piece;

wherein one fastening element extends fixedly from the flange part near a first end area thereof and the other fastening element extends fixedly from the flange part near a second end area thereof opposite to the first end area;

wherein, when mounted, each fastening element extends through a separate notch or opening in the other flange and through an individual notch or opening of the thin wall;

wherein, when mounted, the first flange of the flange part is located closer to a front surface of the thin wall than to a rear surface of the thin wall;

wherein, when mounted, the another flange of the shell part is located closer to the front surface of the thin wall than to the rear surface of the thin wall, and is enclosed in such a way by the first flange that it extends between the front surface of thin wall and the first flange; and wherein, when mounted, the slide of each fastening element is located closer to the rear surface of the thin wall than to the front surface of the thin wall, such that the thin wall is located between each slide and the another flange of the shell part.

2. The handle shell according to claim 1; wherein the other flange is enclosed by or penetrated by the fastening elements.

3. The handle shell according to claim 1; wherein the fastening elements proceeding from the first flange interact in a snap-like manner with an edge of the opening of the thin wall when installed and have a run-in sloped surface and a holding sloped surface at approximately right angles to the latter.

4. The handle shell according to claim 1; wherein the opening provided in the thin wall for the fastening elements is widened or provided with additional notches.

5. The handle shell according to claim 1; wherein the opening in the thin wall is sealed by one or more sealing rings which surround the cross section of the shell proceeding from the other flange and the cross section of the fastening element proceeding from the first flange.

6. The handle shell according to claim 1; wherein the shell part with its flange is configured to be preassembled at the flange part of the handle shell.

7. The handle shell according to claim 1; wherein a grip hole of the flange part of the handle shell has narrowed portions for forming undercuts to facilitate gripping.

8. The handle shell according to claim 1; wherein grip strips extend inward in direction of the shell part from the edges of a grip hole of the flange part.

9. The handle shell according to claim 1; wherein the opening provided in the thin wall for the fastening dements is widened and provided with additional notches.

* * * * *